US007102473B2

(12) United States Patent
Sakai et al.

(10) Patent No.: US 7,102,473 B2
(45) Date of Patent: Sep. 5, 2006

(54) MICRO-RELAY

(75) Inventors: Kouji Sakai, Takarazuka (JP); Hideki Enomoto, Ikoma (JP); Naoki Okumura, Oaska (JP); Tsutomu Shimomura, Toyonaka (JP); Masami Hori, Hirakata (JP)

(73) Assignee: Matsushita Electric Works, Ltd., Osaka (JP)

( * ) Notice: Subject to any disclaimer, the term of this patent is extended or adjusted under 35 U.S.C. 154(b) by 43 days.

(21) Appl. No.: 10/492,642

(22) PCT Filed: Jul. 31, 2003

(86) PCT No.: PCT/JP03/09724

§ 371 (c)(1),
(2), (4) Date: Apr. 14, 2004

(87) PCT Pub. No.: WO2004/017349

PCT Pub. Date: Feb. 26, 2004

(65) Prior Publication Data

US 2005/0156696 A1 Jul. 21, 2005

(30) Foreign Application Priority Data

Jul. 31, 2002 (JP) ..... 2002-223845

(51) Int. Cl.
*H01H 62/07* (2006.01)

(52) U.S. Cl. ..... 335/128; 335/78

(58) Field of Classification Search ..... 335/78–80, 335/124, 128

See application file for complete search history.

(56) References Cited

U.S. PATENT DOCUMENTS 5,557,132 A * 9/1996 Takahashi ..... 257/415
5,606,447 A * 2/1997 Asada et al. ..... 359/199
5,872,496 A * 2/1999 Asada et al. ..... 335/78

(Continued)

FOREIGN PATENT DOCUMENTS

DE 198 20 821 C1 12/1999

(Continued)

OTHER PUBLICATIONS

International Search Report for PCT/JP03/09724 mailed on Dec. 9, 2003.

(Continued)

*Primary Examiner*—Elvin Enad
*Assistant Examiner*—Bernard Rojas
(74) *Attorney, Agent, or Firm*—Rader, Fishman & Grauer PLLC

(57) ABSTRACT

This micro relay comprises a body 1, a cover 4, an armature block 3. The body 1, which is made of silicon or glass, has an electromagnetic mechanism 2. The cover 4 is also made of silicon or glass. The armature block 3 is made of silicon. The armature block 3 is composed of an armature base 30 and a frame 31. The frame 31 surrounds an entire circumference of the armature base 30 and supports the armature base 30 pivotally. The armature base 30 is cooperative with a magnetic material 32 on a surface of the armature base 30 to define an armature 300. A fixed contacts 14A, 14B, 15A, 15B and movable contacts 33A, 33B are selectively closed and opened by a pivot motion of the armature 300. And, the frame 31 is directly bonded over its entire circumference to a periphery 19 of the body 1 and to a periphery 41 of the cover 4 to define a sealed space surrounded by the frame 31 and closed between the body 1 and the cover 4 for accommodating the armature 300 and the fixed contacts and the movable contacts.

7 Claims, 7 Drawing Sheets

U.S. PATENT DOCUMENTS 6,492,887 B1 12/2002 Diem et al.

FOREIGN PATENT DOCUMENTS

| | | | | |
|---|---|---|---|---|
| JP | 63-175450 | A1 | | 7/1988 |
| JP | 06-084441 | A1 | | 3/1994 |
| JP | 07-176255 | A1 | | 7/1995 |
| JP | 07-193160 | A1 | | 7/1995 |
| JP | 2001-076605 | A1 | | 3/2001 |
| JP | 2005216547 | A | * | 8/2005 |
| WO | WO-99/27548 | A1 | | 6/1999 |

OTHER PUBLICATIONS

Supplementary Partial European Search Report for co-pending application EP 03 78 8021 mailed on Feb. 2, 2005.

* cited by examiner

MICRO-RELAY

TECHNICAL FIELD

The present invention relates to a micro relay manufactured using semiconductor micromachining technology and, more particularly, to a sealed micro relay having a contact mechanism which operates in a sealed space.

BACKGROUND ART

A common micro relay comprises an electromagnetic mechanism, an armature, and a contact mechanism having a fixed contact and a movable contact which are selectively closed and opened by a pivot motion of the armature. Preferably, the contact mechanism of the micro relay is disposed in a sealed space in order to prevent dust or dirt from settling on the movable contact, or in order to improve switching performance of the contacts. For this reason, in the common micro relay, a body and a cover are sealed with a sealing agent after the armature and the contact mechanism are placed in a space formed by the body and the cover.

However, as the micro relay becomes miniaturized, it becomes more difficult to seal the micro relay with the sealing agent. Furthermore, using the sealing agent is a waste of money and the sealing process is a waste of time.

DISCLOSURE OF THE INVENTION

In view of the above problems, the object of the present invention is to provide a sealed micro relay which is small and can be manufactured easily.

A micro relay in accordance with the present invention comprises a body, a cover, an armature block, and a contact mechanism. The body, which is made of silicon or glass, has an electromagnetic mechanism. The cover is also made of silicon or glass. The armature block is made of silicon. The armature block is composed of an armature base and a frame. The frame surrounds an entire circumference of the armature base and supports the armature base pivotally. The armature base is cooperative with a magnetic material on a surface of the armature base to define an armature. The contact mechanism has a fixed contact and a movable contact which are selectively closed and opened by a pivot motion of the armature. And, the frame is directly bonded over its entire circumference to a periphery of the body and to a periphery of the cover to define a sealed space surrounded by the frame and closed between the body and the cover for accommodating the armature and the contact mechanism.

Therefore, because the body and the cover of the micro relay are directly bonded to the frame, there is no need to seal between the body and the cover with a sealing agent in order to dispose the armature and the contact mechanism in a sealed space. Also, because the bonding between the body and the frame and the bonding between the cover and the frame are either a bonding of the silicon and the glass or a bonding of the silicon and the silicon respectively, the body, the frame and the cover can be bonded easily by using a well-known bonding method. Furthermore, the micro relay can be miniaturized easily by using semiconductor micromachining technology for a process of the silicon and the glass.

Preferably, the electromagnetic mechanism has a yoke which forms a magnetic path of a magnetic field generated upon being energized, and the body has an opening extending from an upper surface of the body to an undersurface of the body, and one end of the opening on the upper surface side is closed by a thin film to form a recess for accommodating the yoke in the undersurface of the body. The thin film is made of silicon or glass and is closely bonded to the body to isolate the sealed space from the recess.

In this case, isolating the sealed space from the recess only by the thin film minimizes a magnetic gap between the yoke in the recess and the armature in the sealed space, and thereby can increase a suction power of the electromagnetic mechanism, while keeping the airtightness of the sealed space. Furthermore, the suction power can be adjusted by adjustment of the thickness of the thin film.

Preferably, the body has a through-hole extending from an upper surface of the body to an undersurface of the body, an electric pathway formed inside the through-hole for an electrical connection between an electric circuit on a printed board for carrying the micro relay and the contact mechanism inside the sealed space, and a closure means for closing an opening of the through-hole.

In this case, an electrical connection between the contact mechanism and the electric circuit on the printed board can be made easily by the electric pathway. The airtightness of the sealed space is maintained by the closure means.

The closure means may be a bump provided across the opening of the through-hole on the undersurface side. In this case, the micro relay can be mounted on the printed board by flip-chip bonding, while keeping the through-hole closed.

Preferably, the armature base has a wall thickness less than that of the frame, and the armature base is supported by the frame so that an undersurface of the armature is recessed with respect to an undersurface of the frame, thereby forming a space for accommodating the pivot motion of the armature.

In this case, the space for accommodating the pivot motion of the armature can be obtained between the undersurface of the armature and the body only by bonding the body and the frame to each other.

Preferably, the armature base is supported to the frame by an elastic piece having elastic deformability, and one end of the elastic piece is integrally connected to the armature base and the other end of the elastic piece is integrally connected to the frame, and the elastic piece has a meandering part between the one end and the other end which meanders within the plane common to the frame.

In this case, the elastic piece can be lengthened as long as possible in a limited space within the frame, therefore, a spring constant of a spring force produced by a torsion of the elastic piece when the armature base is in the pivot motion can be reduced appropriately. Furthermore, a stress added to the elastic piece can be dispersed.

Preferably, the meandering part includes at least one U-shaped configuration. In this case, the elastic piece can be lengthened efficiently.

Preferably, one of the armature base and the body is formed with a protrusion on its surface opposing to the other of the armature base and the body, and the armature base is supported on an apex of the protrusion to make the pivot motion about the apex. In this case, the armature base can pivot stably because it is supported by the body, too, through the protrusion. Furthermore, because the protrusion is provided between the armature and the body, a case where an excessive suction power of the electromagnetic mechanism adsorbs the whole armature to the body and thereby the armature can not make the pivot motion is prevented.

BEST MODE FOR CARRYING OUT THE INVENTION

Hereinafter, the present invention will be described in more detail with reference to the accompanying drawings.

Figure 1:
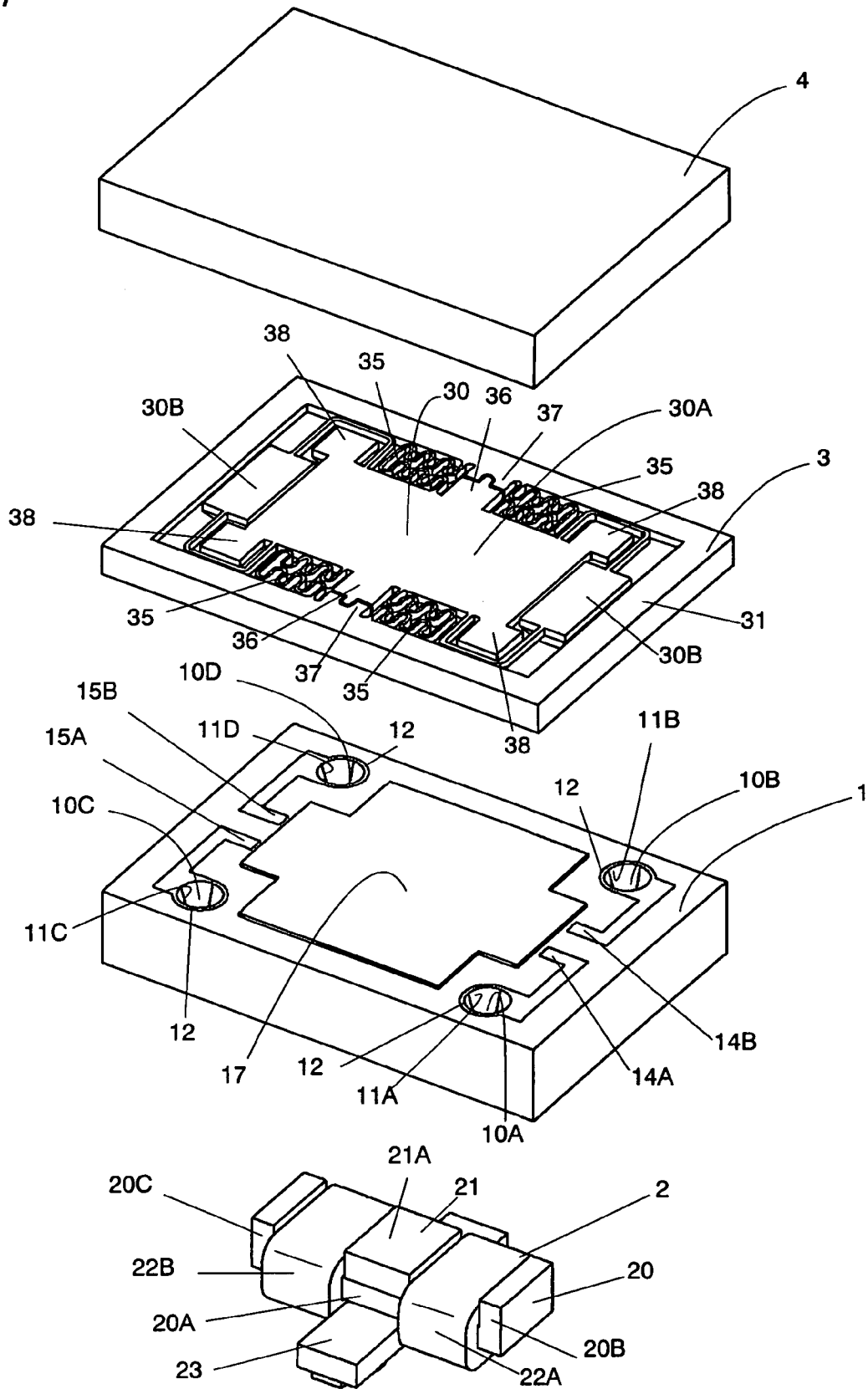
FIG. 1 is an exploded perspective view of a micro relay in accordance with a first embodiment of the present invention.

FIG. 1 shows a micro relay in accordance with a first embodiment of the present invention. This micro relay comprises a body 1, an electromagnetic mechanism 2, an armature block 3, and a cover 4.

Figure 2:
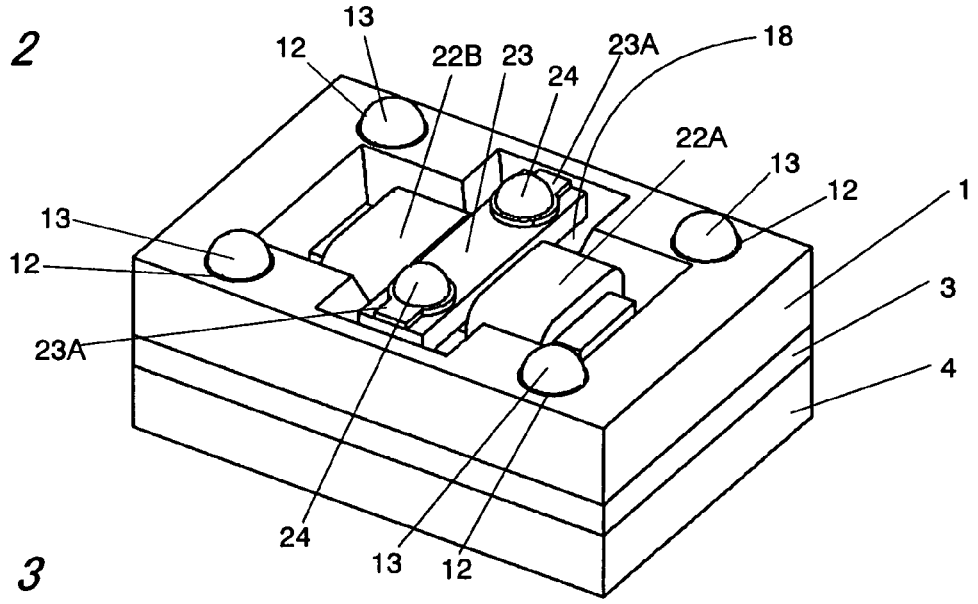
FIG. 2 is a perspective view of the micro relay looking from a bottom side.

The body 1 is a glass substrate in the shape of a rectangle. The body 1 has, near its four corners, through-holes 10A to 10D each of which extends from an upper surface of the body 1 to an undersurface of the body 1. On an interior surface of each of the through-holes 10A to 10D, an electric pathway 11A–11D for an electrical connection between an electric circuit (not shown) on a printed board for carrying the micro relay and a fixed contact (describes later) is formed. Each of the electric pathways 11A to 11D is made of, for example, chrome, titanium, platinum, cobalt, nickel, gold, a gold-cobalt alloy, or an alloy of them, and formed by, for example, plating, deposition, or sputtering. In a periphery of an opening of each end of each through-hole, a land 12 connected to a nearby electric pathway is formed. As shown in FIG. 2, a bump 13 is putted on each of the lands 12 of the underside of the body 1. Each bump 13 is closely bonded to the land 12 by, for example, heat in order to close the opening of the underside of each through-hole.

On the upper surface of the body 1, two pairs of the fixed contacts 14A–14B, 15A–15B are formed. Each of the two pairs of the fixed contacts (at least the surface of the fixed contacts), is made of, for example, chrome, titanium, platinum, cobalt, nickel, gold, a gold-cobalt alloy, or an alloy of them. The fixed contacts 14A, 14B are disposed between two through-holes 10A, 10B in spaced relation to each other. One fixed contact 14A is electrically connected to the land 12 of the through-hole 10A, and the other fixed contact 14B is electrically connected to the land 12 of the through-hole 10B. In the same way, the fixed contacts 15A, 15B are disposed between two through-holes 10C, 10D in spaced relation to each other, and one fixed contact 15A is electrically connected to the land 12 of the through-hole 10C, and the other fixed contact 15B is electrically connected to the land 12 of the through-hole 10D.

Figure 3:
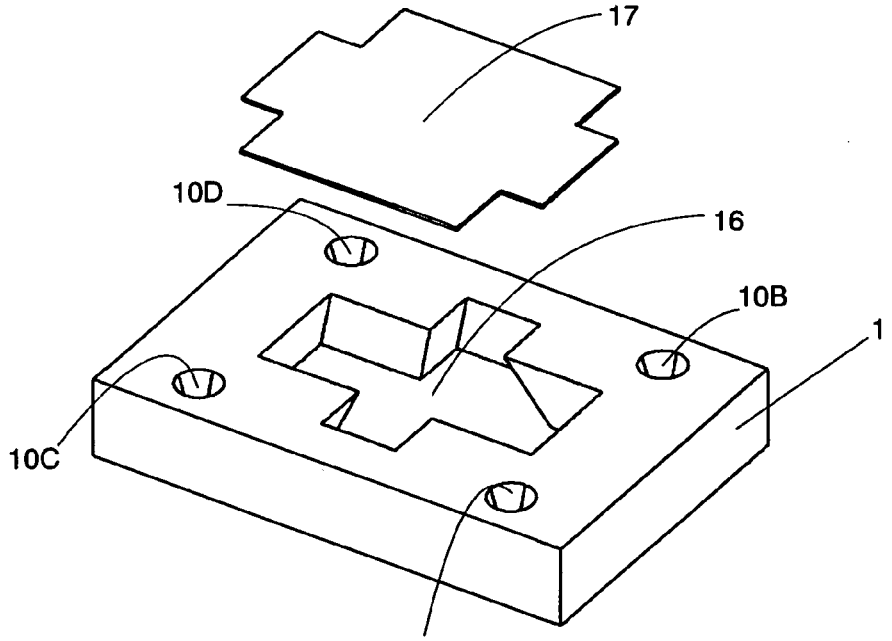
FIG. 3 is an exploded perspective view of a body of the micro relay.

As shown in FIG. 3, a cross-shaped opening 16 which extends from the upper surface of the body 1 to the undersurface of the body is provided in the middle of the body 1. And, a thin film 17 is closely bonded to the upper surface of the body 1 to close the opening 16, thereby forming a recess 18 for accommodating the electromagnetic mechanism 2 on the underside of the body 1, as shown in FIG. 2. The thin film 17 is made of silicon or glass, and is processed by etching, grinding, etc. so that its thickness is in the range of 5 μm to 50 μm (preferably about 20 μm).

The electromagnetic mechanism 2 comprises a yoke 20, a permanent magnet 21, coils 22A, 22B, and a board 23. The yoke 20 is made of an iron plate, such as a soft magnetic iron sheet, and is a shape having two rectangular leg pieces 20B, 20C standing from both ends of a rectangular center piece 20A. The yoke 20 is formed by, for example, bending process or forging process. The permanent magnet 21 is a box shape, and its opposite faces 21A, 21B (21B is not shown) are magnetized to different poles to each other. The permanent magnet 21 is attached to the yoke 20 so that one pole face 21B is in contact with a middle of the center piece 20A of the yoke 20 and the other pole face 21A is the same height as tops of the leg pieces 20B and 20C. The coils 22A, 22B are wound around the center piece 20A, directly, between the leg pieces 20B and the permanent magnet 21 and between the leg pieces 20C and the permanent magnet 21. The board 23 is in the shape of a rectangle, and is bonded to an underside of the center piece 20A of the yoke 20 in a direction perpendicular to the center piece 20A. As shown in FIG. 2, the board 23 has conductive materials 23A on its underside, and terminals of the coils 22A, 22B are electrically connected thereto, respectively. Each of the conductive materials 23A has a bump 24 for an electrical connection between the electric circuit (not shown) on the printed board for carrying the micro relay and the coils.

Figure 4:
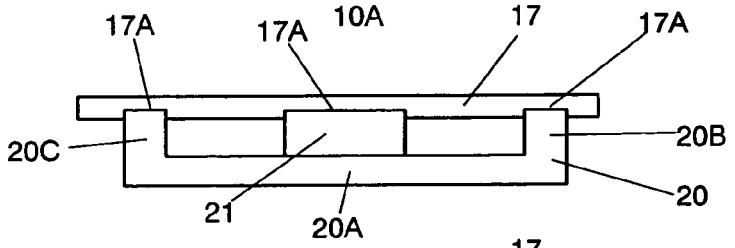
FIG. 4 and FIG. 5 are a schematic illustration showing engagement of a thin board and a yoke, respectively.
Figure 5:
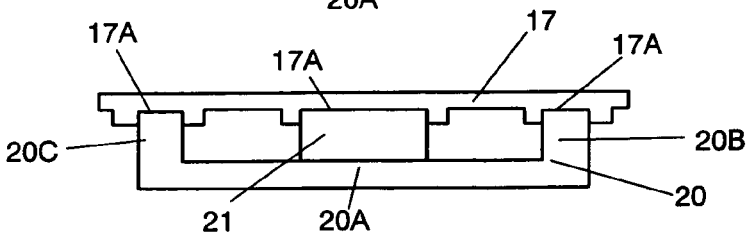

The electromagnetic mechanism 2 is disposed in the recess 18 with the leg pieces 20B, 20C turned up. As shown in FIG. 4 or FIG. 5, positioning parts 17A, which are composed of recesses or protrusions, are formed on the underside of the thin film 17, and the electromagnetic mechanism 2 is disposed in the recess 18 with the top of each of the leg pieces and the pole face 21A fitted into the positioning parts 17A. Therefore, the electromagnetic mechanism 2 is disposed in the recess 18 with a high degree of accuracy.

Figure 6:
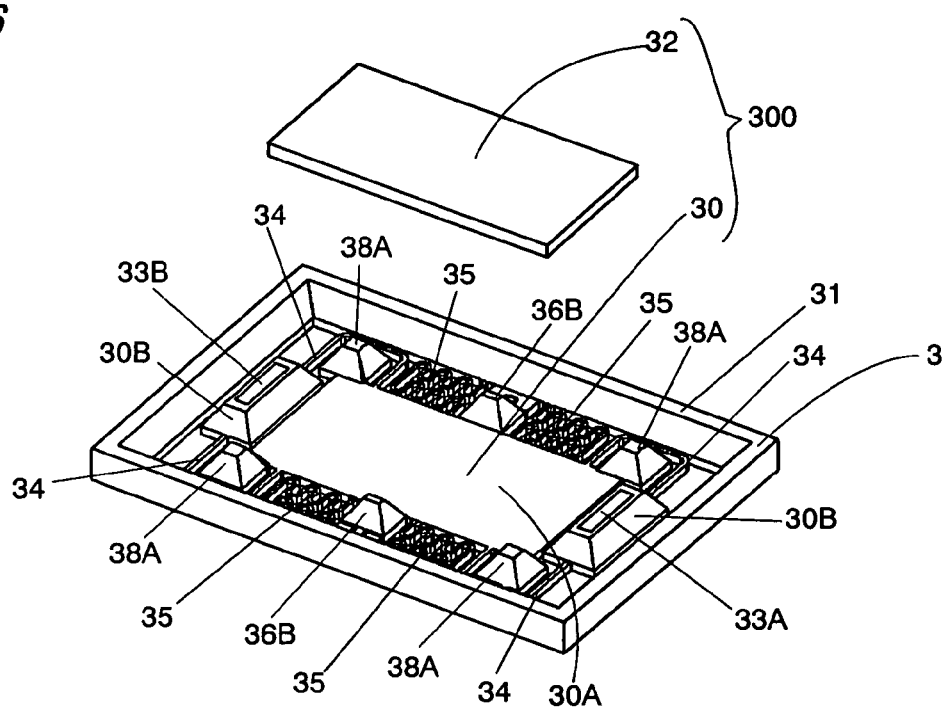
FIG. 6 is an exploded perspective view of an armature block of the micro relay looking from a bottom side.

The armature block 3 is formed by etching from a silicon substrate whose thickness is in the range of 50 μm to 300 μm (preferably about 200 μm). The armature block 3 is composed of an armature base 30 and a frame 31. The frame 31 surrounds an entire circumference of the armature base 30 and supports the armature base 30 pivotally. As shown in FIG. 6, a rectangular magnetic material 32 is bonded to the undersurface of the armature base 30. The armature base 30 and the magnetic material 32 define an armature 300.

Figure 7:
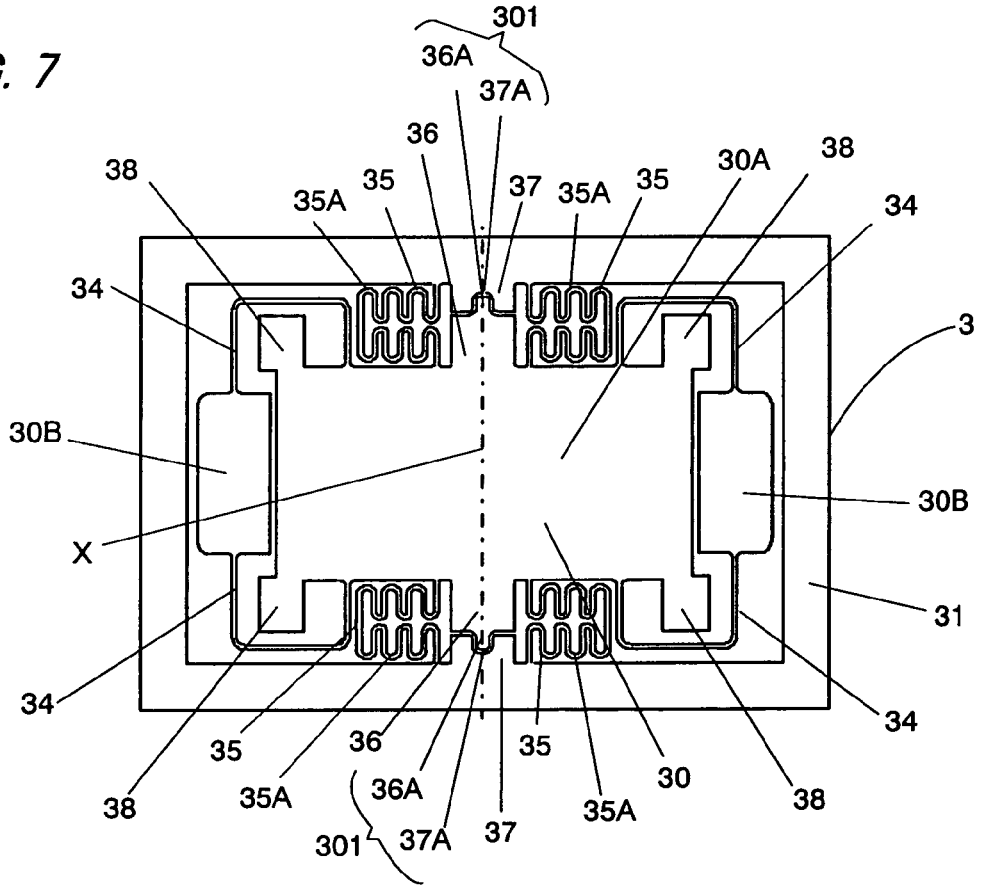
FIG. 7 is a top view of the armature block of the micro relay.

As shown in FIG. 6 and FIG. 7, the armature base 30 is composed of a rectangular magnetic material holder 30A which holds the magnetic material 32 on its underside, and movable contact holders 30B which hold movable contacts 33A, 33B on their underside, respectively. The movable contact holders 30B are disposed on both sides of the longitudinal direction of the magnetic material holder 30A, and are held to the magnetic material holder 30A by hinge pieces 34 having elastic deformability.

Both sides of the width direction of the magnetic material holder 30A are held to the frame 31 by elastic pieces 35 having elastic deformability. The elastic pieces 35 are located symmetrically at four places, regarding an axis X of a pivot motion of the armature base 30 as the line of symmetry. One end of each of the elastic pieces 35 is integrally connected to the magnetic material holder 30A, and the other end of each of the elastic pieces is integrally connected to the frame 31. Each of the elastic pieces 35 has a meandering part 35A between the one end and the other end which meanders within the plane common to the frame. The meandering part 35A includes many U-shaped configurations.

The magnetic material holder 30A has extended pieces 36 at the center of both sides of the width direction. Each of the extended pieces 36 has a convex part 36A on its surface opposing to the frame 31. The frame 31 has extended pieces 37 each of which has a concave part 37A at the position opposite to each of the convex parts 36A on the inner surface of the frame 31. The convex part 36A is engaged into the concave part 37A within the plane common to the frame 31, and defines a movement restriction part 301 which restricts the horizontal movement of the armature base 30. Each of the extended pieces 36 also has a protrusion 36B on its underside which is used as a supporting point of the pivot motion of the armature base 30.

Furthermore, the magnetic material holder 30A has second extended pieces 38 in its four corners. Each of the second extended pieces 38 has a second protrusion 38A on its undersurface which is used as a stopper of the pivot motion of the armature base 30.

The magnetic material 32 is made of magnetic material, such as soft magnetic iron, magnetic stainless, and Permalloy, and is processed by machine work. The magnetic material 32 is bonded to the magnetic material holder 30A by, for example, adhesive bonding, welding, heat bonding, or brazing.

The armature base 30 has a wall thickness less than that of the frame 31, and is held to the upper side of the frame 31 so that the underside of the armature 300 (i.e., the underside of the magnetic material 32 and the underside of the movable contacts 33A, 33B) is recessed with respect to the underside of the frame 31. Thereby, a space for accommodating the pivot motion of the armature 300 is formed between the underside of the armature 300 and the body 1 when the frame 31 is bonded to the body 1, as described later.

Figure 8:
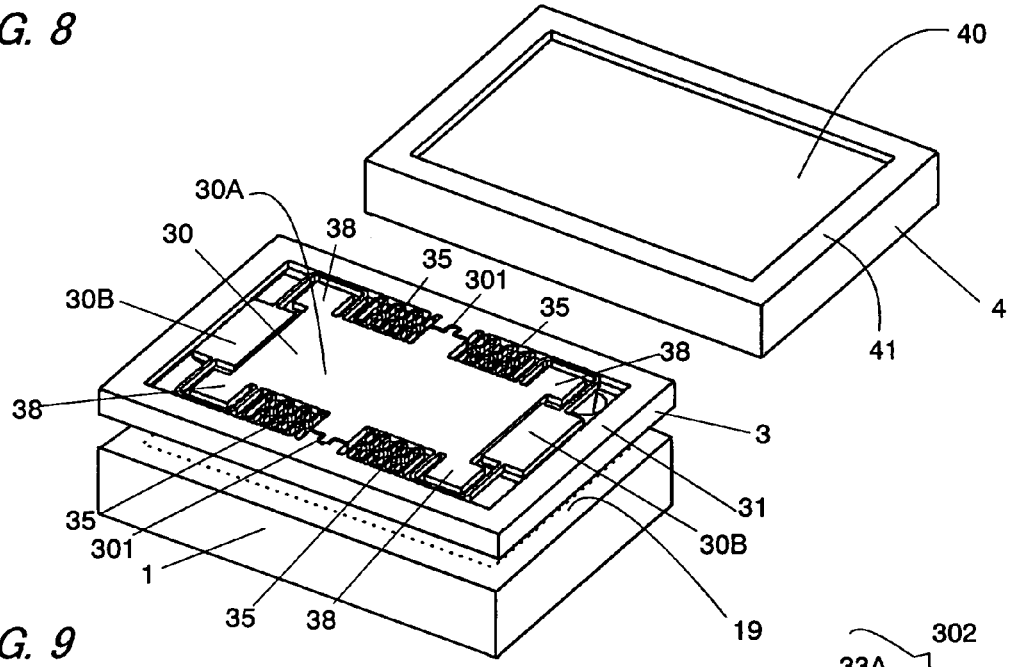
FIG. 8 is an exploded perspective view of the micro relay with its cover opened.
Figure 9:
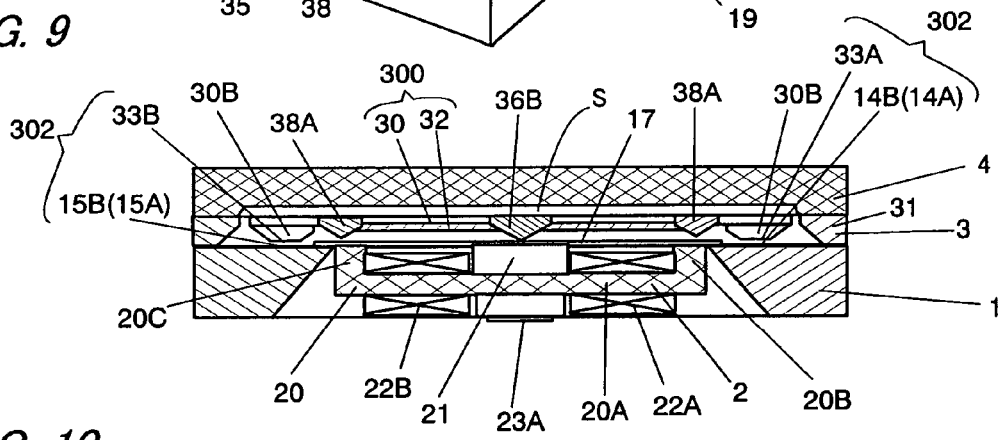
FIG. 9 is a section view of the micro relay.

The cover 4 is made of heat resistance glass, such as Pyrex (R), and is in the shape of a rectangle. The cover 4 has a recess 40 for accommodating the pivot motion of the armature 300 on its underside, as shown in FIG. 8.

The frame 31 of the armature block 3, formed as above, is directly bonded over its entire circumference to a periphery 19 of the body 1 and to a periphery 41 of the cover 4 using, for example, anodic bonding. Thereby, a sealed space surrounded by the frame and closed between the body and the cover is formed, and the armature 300 and the movable contacts 33A, 33B, and the fixed contacts 14A, 14B, 15A, 15B are disposed thereinto. The movable contacts 33A, 33B, and the fixed contacts 14A, 14B, 15A, 15B make up a contact mechanism 302 in which the movable contacts and the fixed contacts are selectively opened and closed by the pivot motion of the armature 300. An apex of the protrusion 36B of the armature block 3 touches the thin film 17.

Hereinafter, the workings of the micro relay will be described. When the coils 22A, 22B are energized in one direction, the magnetic material 32 is attracted to the one leg piece 20B, and thereby the armature 300 makes the pivot motion about the apex of the protrusion 36B. The pivot motion of the armature 300 is stopped when the second protrusions 38A which are provided as stoppers on the underside of the second extended pieces 38 touch the upper surface of the body 1. At this time, the movable contact 33A on the underside of the movable contact holder 30B is brought into contact with the opposed pair of the fixed contacts 14A, 14B, and closes between the fixed contacts 14A, 14B. The movable contact 33A obtains appropriate contact pressure by elastic force of the hinge pieces 34. If the energization of the coils 22A, 22B is stopped, the armature 300 keeps the same state by a magnetic flux flowing through a closed magnetic path; the permanent magnet 21→the magnetic material 32→the leg piece 20B→the permanent magnet 21.

On the other hand, when the coils 22A, 22B are energized in the inverse direction, the magnetic material 32 is attracted to the other leg piece 20C, and the armature 300 makes the reverse pivot motion about the apex of the protrusion 36B by a return force of the elastic pieces 35 in addition to the magnetic suction power. At this time, the movable contact 33B on the underside of the movable contact holder 30B is brought into contact with the opposed pair of the fixed contacts 15A, 15B, and closes between the fixed contacts 15A, 15B. The movable contact 33B obtains appropriate contact pressure by elastic force of the hinge pieces 34. If the energization of the coils 22A, 22B is stopped, the armature 300 keeps the same state by a magnetic flux flowing through a closed magnetic path; the permanent magnet 21→the magnetic material 32→the leg piece 20C →the permanent magnet 21. That is, the micro relay of this embodiment is configured as a latching relay having a normally open contact and a normally closed contact.

As mentioned above, the micro relay of the present invention can be manufactured easily by disposing the armature block 3 between the body 1 and the cover 4, and then bonding the body 1 to one side of the frame 31 directly and bonding the cover 4 to the other side of the frame 31 directly. It is preferable to manufacture a lot of micro relay at one time by forming a lot of bodies 1 on one wafer and forming a lot of armature blocks 3 on another wafer and combing both of the wafers. The body 1, the armature block 3, and the cover 4 can be miniaturized easily by semiconductor micromachining technology. In order to mount the micro relay on the printed board (not shown), the bumps 13, 24 on the underside of the body 1 are bonded to the printed board by flip-chip bonding.

In addition, the protrusion 36B prevents the whole armature 300 from being absorbed to the body 1, and thereby a spring constant of the elastic piece 35 can be reduced appropriately. In addition, providing the protrusion 36B enables the armature 300 to make the pivot motion stably.

In addition, providing the second protrusion 38A as a stopper prevents the magnetic material 32 and the thin film 17 from bumping against each other and being damaged. Furthermore, an over travel amount of the movable contacts 33A, 33B can be adjusted by adjustment of the distance between the second protrusion 38A and the body 1.

In addition, if a recess for accommodating the pivot motion of the armature 300 were formed in the body 1, like the recess 40 formed in the cover 4, the size of body would have to be enlarged, because the recess 18 is also formed in the body 1. But, in the micro relay of the present invention, since it is not necessary to provide a recess in the body 1, the micro relay can be miniaturized.

Figure 10:
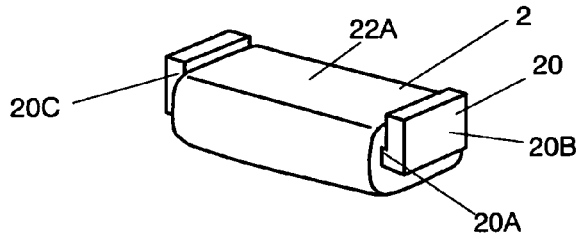
FIG. 10 is another configuration of an electromagnetic mechanism of the micro relay.

In addition, although the electromagnetic mechanism 2 in this embodiment is a polarized electromagnetic mechanism having the permanent magnet 21, a nonpolar electromagnetic mechanism having no permanent magnet may be used, as shown in FIG. 10.

Figure 11:
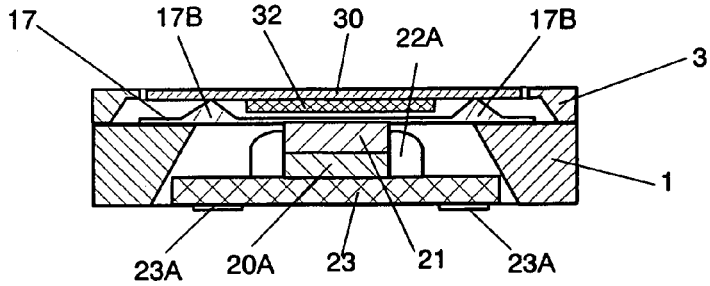
FIG. 11 is another configuration of a protrusion of the micro relay.

In addition, although the protrusion 36B is provided on the underside of the armature base 30 (the extended piece 36) in this embodiment, a protrusion 17B, as shown in FIG. 11, instead of the protrusion 36B, may be provided on the upper surface of the thin film 17 for the armature base 30 to make the pivot motion about the apex of the protrusion 17B.

In addition, although the body and the cover are made of glass in this embodiment, the body and the cover may be made of silicon.

Figure 12:
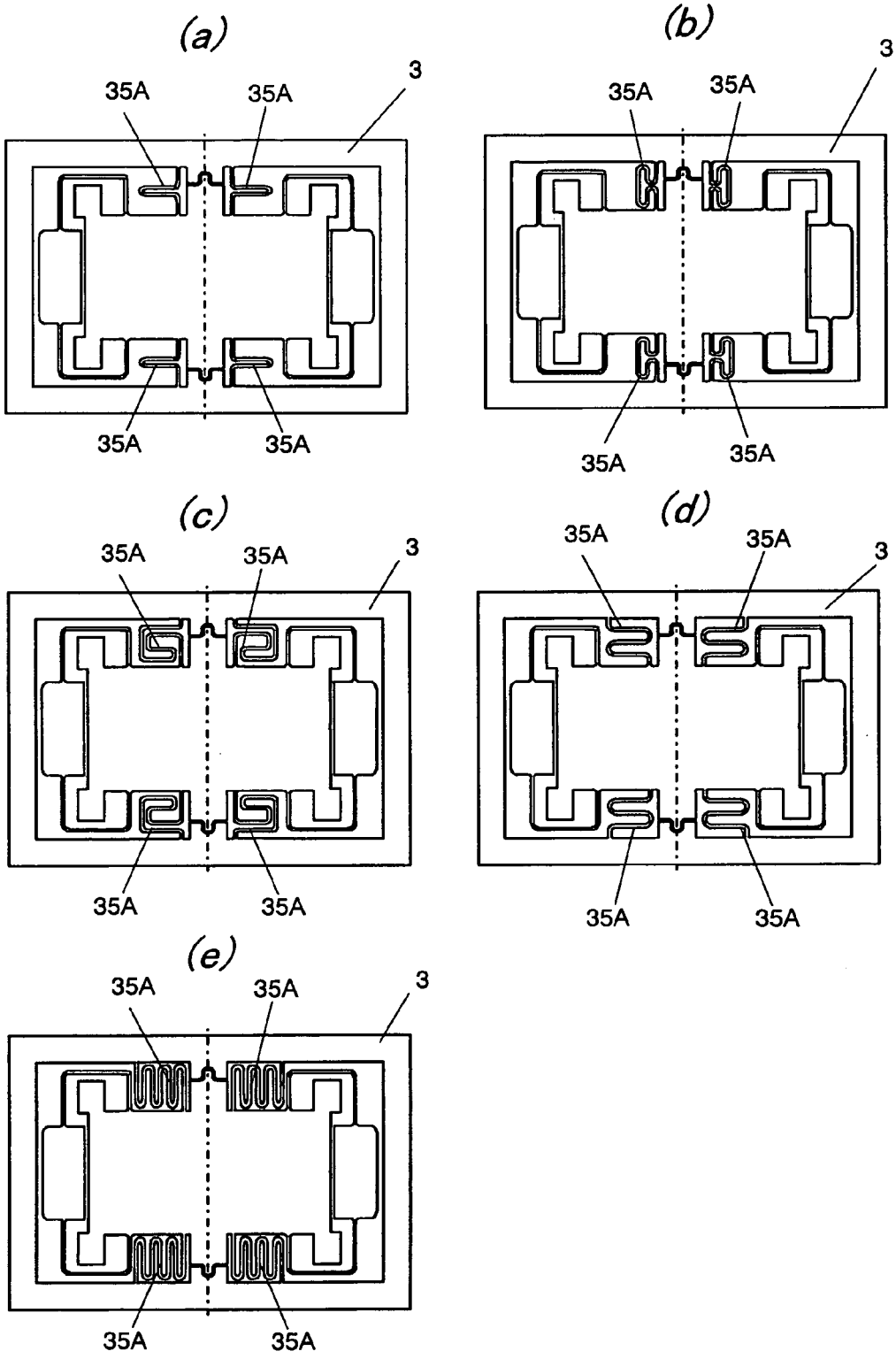
FIG. 12, consisting of FIGS. 12(*a*) to FIG. 12(*e*), is another configuration of a meandering part of the micro relay.

In addition, the meandering part 35A may be a shape shown in FIGS. 12(*a*) to 12 (*d*). The width and the shape of the meandering part 35A are determined according to the spring constant required for the elastic piece 35. If the length of the elastic piece 35 is long, a stress added to the elastic piece 35 can be dispersed.

Figure 13:
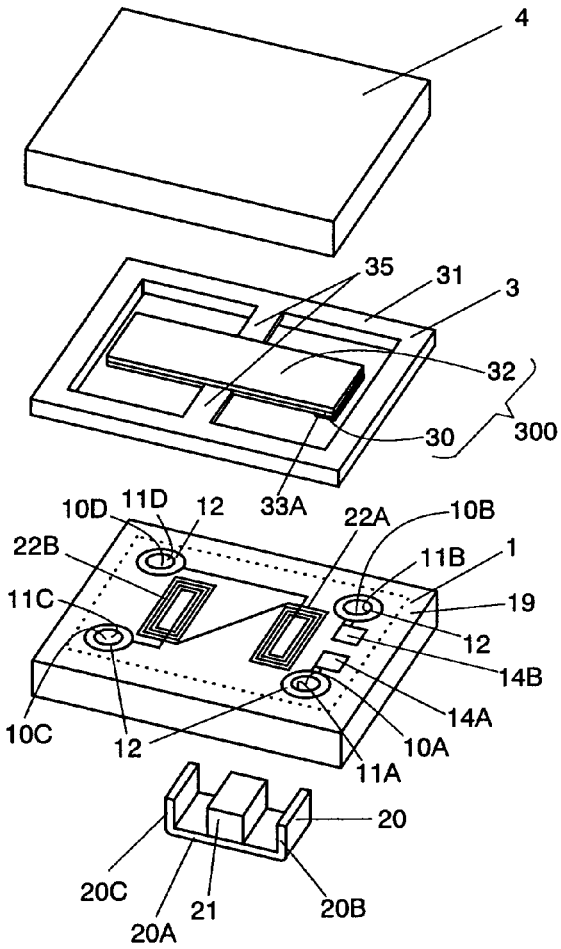
FIG. 13 is an exploded perspective view of a micro relay in accordance with a second embodiment of the present invention.

FIG. 13 shows a micro relay in accordance with a second embodiment of the present invention. The micro relay has a coil formed on the surface of the body, and the similar part between the first embodiment and the second embodiment is identified by the same reference character, and no duplicate explanation is made here.

The coils 22A, 22B, each of which is in the shape of a spiral, are formed on the surface of the body 1 by patterning process. One end of the coil 22A and one end of the coil 22B are connected to each other, and the other end of the coil 22A is connected to the land 12 of the through-hole 10D and the other end of the coil 22B is connected to the land 12 of the through-hole 10C. The coils 22A, 22B are formed by repeating the process forming a thin film of aluminum by the photolithography and the process forming an insulator film (silicon-oxide film) on the thin film of aluminum by CVD method using TEOS so that these coils have laminated structure.

Figure 14:
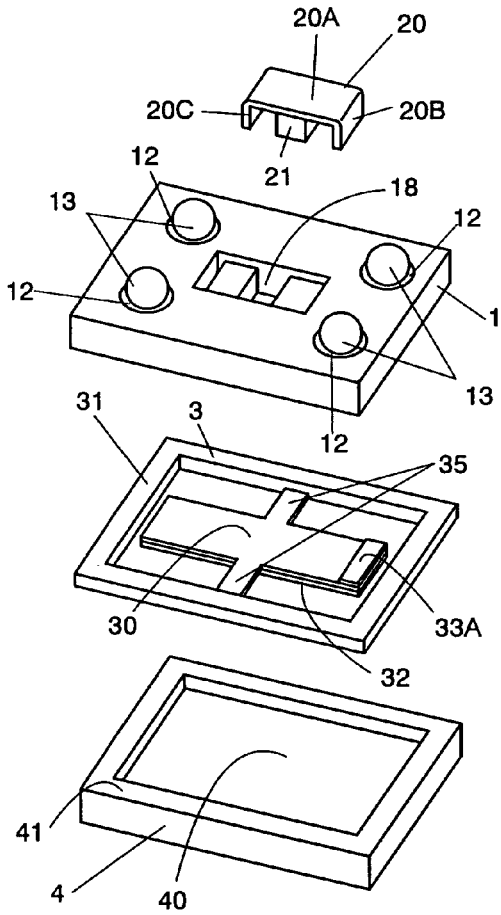
FIG. 14 is a perspective view of the micro relay looking from a bottom side.

A recess 18 for accommodating the yoke 20 and the permanent magnet 21 is formed on the underside of the body 1 by blast process, as shown in FIG. 14.

The armature base 30 is made of silicon and is in the shape of a rectangle. The magnetic material 32 is formed on the upper surface of the armature base 30 by, for example, plating, deposition, or sputtering. The armature base 30 and the magnetic material 32 define the armature 300. On the underside of the armature base 30, the rectangular movable contact 33A is fixed at one end of the longitudinal direction. Each center of both sides of the width direction of the armature base 30 is held to the frame 31 by elastic pieces 35. Each of the armature base 30 and the elastic pieces 35 has a wall thickness less than that of the frame 31, and the armature base 30 is held to the upper side of the frame 31 so that the underside of the armature 300 is recessed with respect to the underside of the frame 31. The armature 300 makes a pivot motion about the elastic pieces 35.

As is the case with the first embodiment, the frame 31 of the armature block 3 is directly bonded over its entire circumference to the periphery 19 of the body 1 and to the periphery 41 of the cover 4, thereby making up a sealed micro relay having one contact.

As mentioned above, making the coils 22A, 22B directly on the surface of the body 1 enables the micro relay to be miniaturized more.

Figure 15:
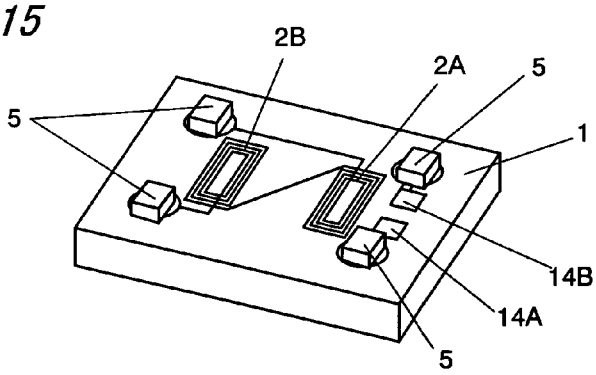
FIG. 15 is another configuration of a body of the micro relay.

Although the through-holes 10A to 10D are closed by bumps 13, the opening on the upper side of each of the through-holes 10A to 10D may be closed by a cap 5 as a closure means, as shown in FIG. 15, if there is a possibility of generating a clearance between the land 12 and the bump 13 which is melted by flip-chip bonding. Preferably, the cap 5 is isolated from a silicon substrate when the armature block 3 is formed.

Figure 16:
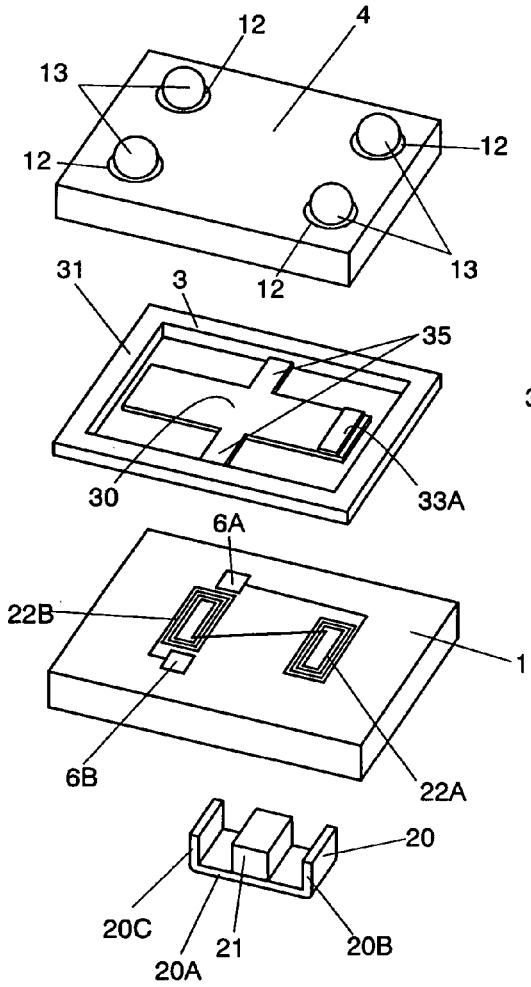
FIG. 16 is an exploded perspective view of a micro relay in accordance with a third embodiment of the present invention.

FIG. 16 shows a micro relay in accordance with a third embodiment of the present invention. Although forming a coil on the surface of the body, like the second embodiment, enables the micro relay to be miniaturized, such coil tends to have low suction power, as compared with a wound coil, like the first embodiment. In this embodiment, the fixed contacts are formed on the cover in order to enlarge the coil without causing interference with the fixed contacts. The similar part between the first or second embodiment and the third embodiment is identified by the same reference character, and no duplicate explanation is made here.

The coils 22A, 22B and electrode pads 6A, 6B are formed on the upper surface of the body 1. The electrode pads 6A, 6B are located on both sides of the width direction of the coil 22B. One end of the coil 22A and one end of the coil 22B are connected each other, and the other end of the coil 22A is connected to the electrode pad 6A and the other end of the coil 22B is connected to the electrode pad 6B.

Figure 17:
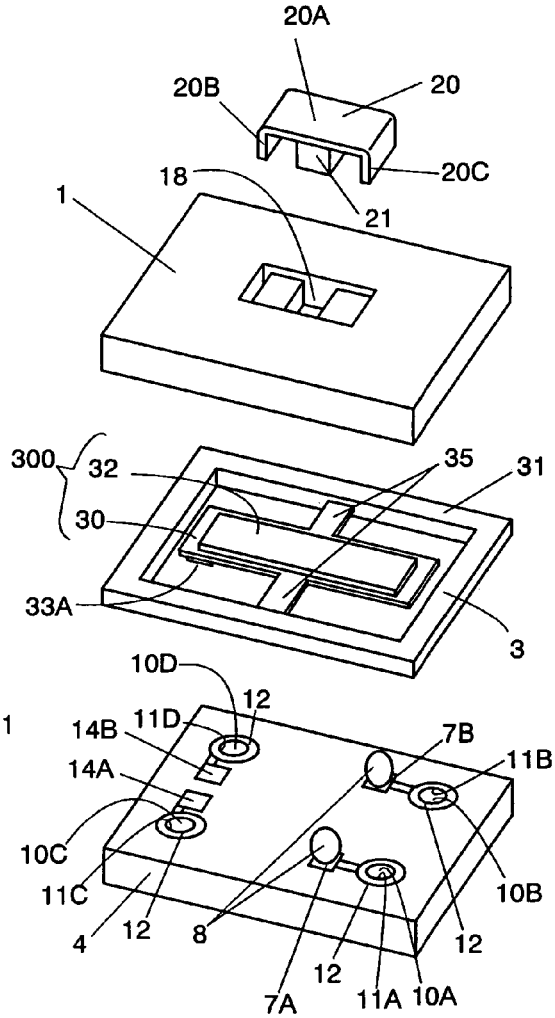
FIG. 17 is an exploded perspective view of the micro relay looking from a bottom side.
Figure 18:
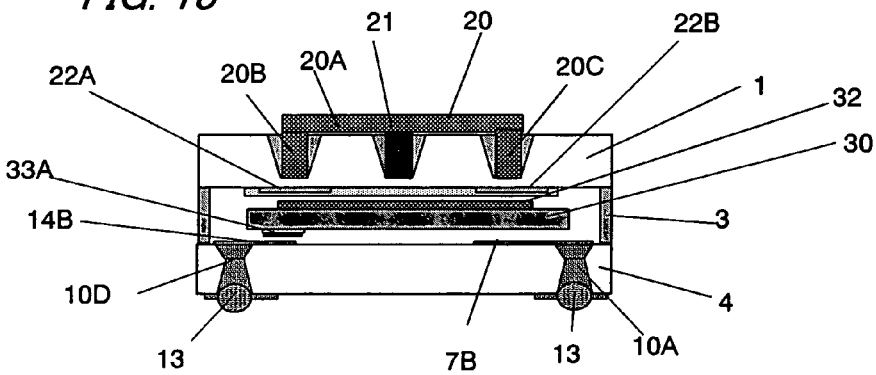
FIG. 18 is a section view of the micro relay.

As shown in FIG. 17, on the upper surface of the armature base 30, the rectangular movable contact 33A is fixed at one end of the longitudinal direction of the armature base 30, and on the underside of the armature base 30, the magnetic material 32 is formed. Each of the armature base 30 and the elastic pieces 35 has a wall thickness less than that of the frame 31, and the armature base 30 is held to the middle of the height direction of the frame 31 so that the underside of the armature 300 is recessed with respect to the underside of the frame 31 as well as the upper surface of the armature 300 is recessed with respect to the upper surface of the frame 31.

The through-holes 10A to 10D, each of which extends from an upper surface of the cover 4 to an underside of the cover 4, are formed near the four corners of the cover 4. On the interior surface of each of the through-holes 10A to 10D, the electric pathway 11A–11D is formed, like the first and second embodiments. In the periphery of the opening of each end of each through-hole, the land 12 is formed. The bump 13 is closely bonded to each of the lands 12 of the upper side of the cover 1 in order to close the upper opening of each of the through-holes 10A to 10D.

On the underside of the cover 4, a pair of the fixed contacts 14A, 14B is formed between the two through-holes 10C, 10D. One fixed contact 14A is connected to the land 12 of the through-hole 10C, and the other fixed contact 14B is connected to the land 12 of the through-hole 10D. Furthermore, on the underside of the cover 4, electrode pads 7A, 7B are formed. One electrode pad 7A is disposed near the through-hole 10A between the through-holes 10A, 10C, and is connected to the land 12 of the through-hole 10A. The other electrode pad 7B is disposed near the through-hole 10B between the through-holes 10B, 10D, and is connected to the land 12 of the through-hole 10B. On the surface of each of the electrode pads 7A, 7B, a metal bump 8, which is made of copper, is provided.

The frame 31 of the armature block 3 is directly bonded over its entire circumference to the periphery 19 of the body 1 and to the periphery 41 of the cover 4, like the first and second embodiments. The tip of each of the metal bumps 8 is brought into contact with each of the electrode pads 6A, 6B provided on the body 1, passing between the armature 300 and the frame 31. This enables the coils 22A, 22B to be energized through the metal bumps 8 from the through-holes 10A, 10B. Because the coils 22A, 22B and the fixed contacts 14A, 14B are formed on separate substrates, the coils 22A, 22B can be enlarged easily in order to increase the suction power. In order to mount the micro relay on the printed board (not shown), the cover 4 is turned downward, then the bumps 13 are bonded to the printed board by flip-chip bonding.

The invention claimed is:

1. A micro relay comprising:

a body having an electromagnetic mechanism, said body being made of silicon or glass;

a cover made of silicon or glass;

an armature block made of silicon, said armature block being composed of an armature base and a frame, said frame surrounding an entire circumference of said armature base and supports said armature base pivotally, said armature base being cooperative with a magnetic material on a surface of said armature base to define an armature;

a contact mechanism having a fixed contact and a movable contact which are selectively closed and opened by a pivot motion of said armature;

wherein said frame is directly bonded over its entire circumference to a periphery of said body and to a periphery of said cover to define a sealed space surrounded by said frame and closed between said body and said cover for accommodating said armature and said contact mechanism, said electromagnetic mechanism having a yoke which forms a magnetic path of a magnetic field generated upon being energized, said body having an opening extending from an upper surface of the body to an undersurface of the body, one end of said opening on the upper surface side being closed by a thin film to form a recess for accommodating said yoke in the undersurface of the body, said thin film being made of silicon or glass and being closely bonded to the body to isolate said sealed space from said recess.

2. The micro relay as set forth in claim 1, wherein said body has a through-hole extending from an upper surface of the body to an undersurface of the body, an electric pathway formed inside the through-hole for an electrical connection between an electric circuit on a printed board for carrying said micro relay and said contact mechanism inside said sealed space, and a closure means for closing an opening of said through-hole.

3. The micro relay as set forth in claim 2, wherein said closure means is defined by a bump provided across the opening of the through-hole on the undersurface side.

4. The micro relay as set forth in claim 1, wherein said armature base has a wall thickness less than that of said frame, said armature base being supported by the frame such that an undersurface of the armature is recessed with respect to an undersurface of the frame, thereby forming a space for accommodating the pivot motion of said armature between the undersurface of the armature and the body.

5. The micro relay as set forth in claim 1, wherein said armature base is supported to said frame by an elastic piece having elastic deformability, one end of said elastic piece being integrally connected to said armature base and the other end of the elastic piece being integrally connected to said frame, said elastic piece having a meandering part between said one end and said the other end which meanders within the plane common to said frame.

6. The micro relay as set forth in claim 5, wherein said meandering part includes at least one U-shaped configuration.

7. The micro relay as set forth in claim 1, wherein said armature base has a protrusion on the surface opposing to said body or said body has a protrusion on the surface opposing to said armature base, said armature base making said pivot motion about said apex.

* * * * *